US006189866B1

(12) United States Patent
Harkins et al.

(10) Patent No.: US 6,189,866 B1
(45) Date of Patent: Feb. 20, 2001

(54) LOAD HANDLING ASSEMBLY

(76) Inventors: Raymond Harkins; M. Danny Harrison, both of 9734 Skillman, Dallas, TX (US) 75243

( * ) Notice: Under 35 U.S.C. 154(b), the term of this patent shall be extended for 0 days.

(21) Appl. No.: 09/518,566

(22) Filed: Mar. 3, 2000

(51) Int. Cl.[7] ..... B66D 1/00

(52) U.S. Cl. ..... 254/332; 254/338; 212/176; 212/245; 212/252

(58) Field of Search ..... 254/323, 325, 254/327, 329, 332, 334, 338, 380; 212/175, 176, 223, 245, 252, 253

(56) References Cited

U.S. PATENT DOCUMENTS

| | | | | |
|---|---|---|---|---|
| 1,345,881 | * | 7/1920 | Purnell et al. | 254/338 |
| 1,584,117 | * | 5/1926 | Mitchell | 212/176 |
| 1,978,999 | * | 10/1934 | Jones | 254/334 |
| 2,496,401 | * | 2/1950 | Mckinney | 212/252 |
| 3,181,707 | * | 5/1965 | Janssen | 254/338 |
| 4,050,587 | * | 9/1977 | Moen | 254/325 |
| 4,706,939 | * | 11/1987 | Gagne | 254/332 |
| 4,838,439 | * | 6/1989 | Baziuk | 242/223 |
| 4,881,864 | * | 11/1989 | Amato | 254/323 |
| 5,083,395 | * | 1/1992 | Daniels | 254/334 |
| 5,431,526 | * | 7/1995 | Peterson et al. | 212/223 |
| 5,788,095 | * | 8/1998 | Watson | 212/252 |
| 5,975,499 | * | 11/1999 | Ostrobrod | 254/329 |
| 6,089,809 | * | 7/2000 | Dellinger | 254/338 |

FOREIGN PATENT DOCUMENTS

| | | | | |
|---|---|---|---|---|
| 193865 | * | 6/1969 | (DE) | 254/334 |
| 1557966 | * | 2/1969 | (FR) | 254/338 |
| 28928 | * | 12/1913 | (GB) | 212/223 |

* cited by examiner

*Primary Examiner*—Donald P. Walsh
*Assistant Examiner*—Emmanuel M. Marcelo
(74) *Attorney, Agent, or Firm*—Joseph N. Breaux

(57) ABSTRACT

A load handling assembly that is attachable to the receiver of a receiver hitch assembly of the pickup truck. The load handling assembly includes a winch assembly in connection with a rotatable support structure to allow heavy loads to be lifted to the level of the pickup truck bed and then rotated into position over the pickup truck bed prior to lowering. To accommodate users stationed on the ground or on the bed of the pickup truck, the rotatable support structure is provided with two separate winch mounting brackets so that the winch could be safely mounted to accommodate operation from the desired location.

1 Claim, 4 Drawing Sheets

LOAD HANDLING ASSEMBLY

TECHNICAL FIELD

The present invention relates to load handling assemblies and more particularly to a load handling assembly that is attachable to a receiver of a receiver hitch assembly of a vehicle that includes a receiver hitch insertable foot assembly, an upright leg assembly, a head assembly, and a winch assembly; the foot assembly including an elongated foot member having a first foot end sized and shaped to fit into the receiver of a receiver hitch assembly and that is provided with a pair of coaxially aligned securing pin apertures that are positioned on the first foot end such that they are alignable with receiver pin apertures formed through the receiver of the receiver hitch when the first end is inserted into the receiver, and a second foot end having a cylinder shaped, upright-connecting axle extending perpendicularly from a sidewall thereof; the upright leg assembly having a leg member including a tubular shaped first leg end having an axle receiving cavity provided therein sized and shaped to receive therein the cylinder shaped, upright-connecting axle such that the upright leg assembly is held in a perpendicular relationship to the foot member and constrained to rotate about cylinder shaped, upright-connecting axle, a leg assembly winch connecting bracket adapted for connection with the winch assembly and a second leg end adapted for connection with the head assembly; the head assembly including a head assembly leg connection structure adapted for connection with the second end of the leg member, a head assembly winch connecting bracket in connection with the head assembly leg connecting structure and adapted for connection with the winch assembly, a tubular, cable guide arm in rigid connection with the head assembly leg connection structure having cable guide passageway provided therethrough between a winch side end of the guide arm and an attachment hook side end of the guide arm, a winch side pulley rotatably installed partially within the cable guide passageway and extending partially past the winch side end of the guide arm, and an attachment hook side pulley rotatably installed partially within the cable guide passageway and extending partially past the attachment hook side end of the guide arm; the winch assembly including a winch mounting structure that is securable to the leg assembly winch connecting bracket and the head assembly winch connecting bracket and a winch in connection with the winch mounting structure having a winch reel having a first cable end of a length of cable wound thereon; the length of cable having a second cable end that is threaded over the winch side pulley, through the cable guide passageway over the attachment hook side pulley and in connection with an attachment hook.

BACKGROUND ART

It is often necessary to carry heavy loads, such as 55 gallon drums, in the bed of a pickup truck. Although pickup trucks easily carry such loads, it is often difficult to lift such heavy loads onto the bed of the pickup truck when a fork lift is unavailable. It would be a benefit, therefore, to have a load handling assembly that could be attached to the receiver of a receiver hitch assembly of the pickup truck that included a winch assembly in connection with a rotatable support structure to allow the heavy load to be lifted to the level of the pickup truck bed and then rotated into position over the pickup truck bed prior to lowering. Because the user could desire to station himself on the ground or on the bed of the pickup truck, it would be a further benefit to have such a load handling assembly that included two separate winch mounting brackets so that the winch could be safely mounted to accommodate operation by a user positioned at either location.

GENERAL SUMMARY DISCUSSION OF INVENTION

It is thus an object of the invention to provide a load handling assembly that includes a receiver hitch insertable foot assembly, an upright leg assembly, a head assembly, and a winch assembly; the foot assembly including an elongated foot member having a first foot end sized and shaped to fit into the receiver of a receiver hitch assembly and that is provided with a pair of coaxially aligned securing pin apertures that are positioned on the first foot end such that they are alignable with receiver pin apertures formed through the receiver of the receiver hitch when the first end is inserted into the receiver, and a second foot end having a cylinder shaped, upright-connecting axle extending perpendicularly from a sidewall thereof; the upright leg assembly having a leg member including a tubular shaped first leg end having an axle receiving cavity provided therein sized and shaped to receive therein the cylinder shaped, upright-connecting axle such that the upright leg assembly is held in a perpendicular relationship to the foot member and constrained to rotate about cylinder shaped, upright-connecting axle, a leg assembly winch connecting bracket adapted for connection with the winch assembly and a second leg end adapted for connection with -the head assembly; the head assembly including a head assembly leg connection structure adapted for connection with the second end of the leg member, a head assembly winch connecting bracket in connection with the head assembly leg connecting structure and adapted for connection with the winch assembly, a tubular, cable guide arm in rigid connection with the head assembly leg connection structure having cable guide passageway provided therethrough between a winch side end of the guide arm and an attachment hook side end of the guide arm, a winch side pulley rotatably installed partially within the cable guide passageway and extending partially past the winch side end of the guide arm, and an attachment hook side pulley rotatably installed partially within the cable guide passageway and extending partially past the attachment hook side end of the guide arm; the winch assembly including a, winch mounting structure that is securable to the leg assembly winch connecting bracket and the head assembly winch connecting bracket and a winch in connection with the winch mounting structure having a winch reel having a first cable end of a length of cable wound thereon; the length of cable having a second cable end that is threaded over the winch side pulley, through the cable guide passageway over the attachment hook side pulley and in connection with an attachment hook.

Accordingly, a load handling assembly is provided. The load handling assembly includes a receiver hitch insertable foot assembly, an upright leg assembly, a head assembly, and a winch assembly; the foot assembly including an elongated foot member having a first foot end sized and shaped to fit into the receiver of a receiver hitch assembly and that is provided with a pair of coaxially aligned securing pin apertures that are positioned on the first foot end such that they are alignable with receiver pin apertures formed through the receiver of the receiver hitch when the first end is inserted into the receiver, and a second foot end having a cylinder shaped, upright-connecting axle extending perpendicularly from a sidewall thereof; the upright leg assembly having a leg member including a tubular shaped first leg end having an axle receiving cavity provided therein sized and shaped to receive therein the cylinder shaped, upright-connecting axle such that the upright leg assembly is held in a perpendicular relationship to the foot member and constrained to rotate about cylinder shaped, upright-connecting axle, a leg assembly winch connecting bracket adapted for connection with the winch assembly and a second leg end adapted for connection with the head assembly; the head assembly including a head assembly leg connection structure adapted for connection with the second end of the leg member, a head assembly winch connecting bracket in connection with the head assembly leg connecting structure and adapted for connection with the winch assembly, a tubular, cable guide arm in rigid connection with the head assembly leg connection structure having cable guide passageway provided therethrough between a winch side end of the guide arm and an attachment hook side end of the guide arm, a winch side pulley rotatably installed partially within the cable guide passageway and extending partially past the winch side end of the guide arm, and an attachment hook side pulley rotatably installed partially within the cable guide passageway and extending partially past the attachment hook side end of the guide arm; the winch assembly including a winch mounting structure that is securable to the leg assembly winch connecting bracket and the head assembly winch connecting bracket and a winch in connection with the winch mounting structure having a winch reel having a first cable end of a length of cable wound thereon; the length of cable having a second cable end that is threaded over the winch side pulley, through the cable guide passageway over the attachment hook side pulley and in connection with an attachment hook.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
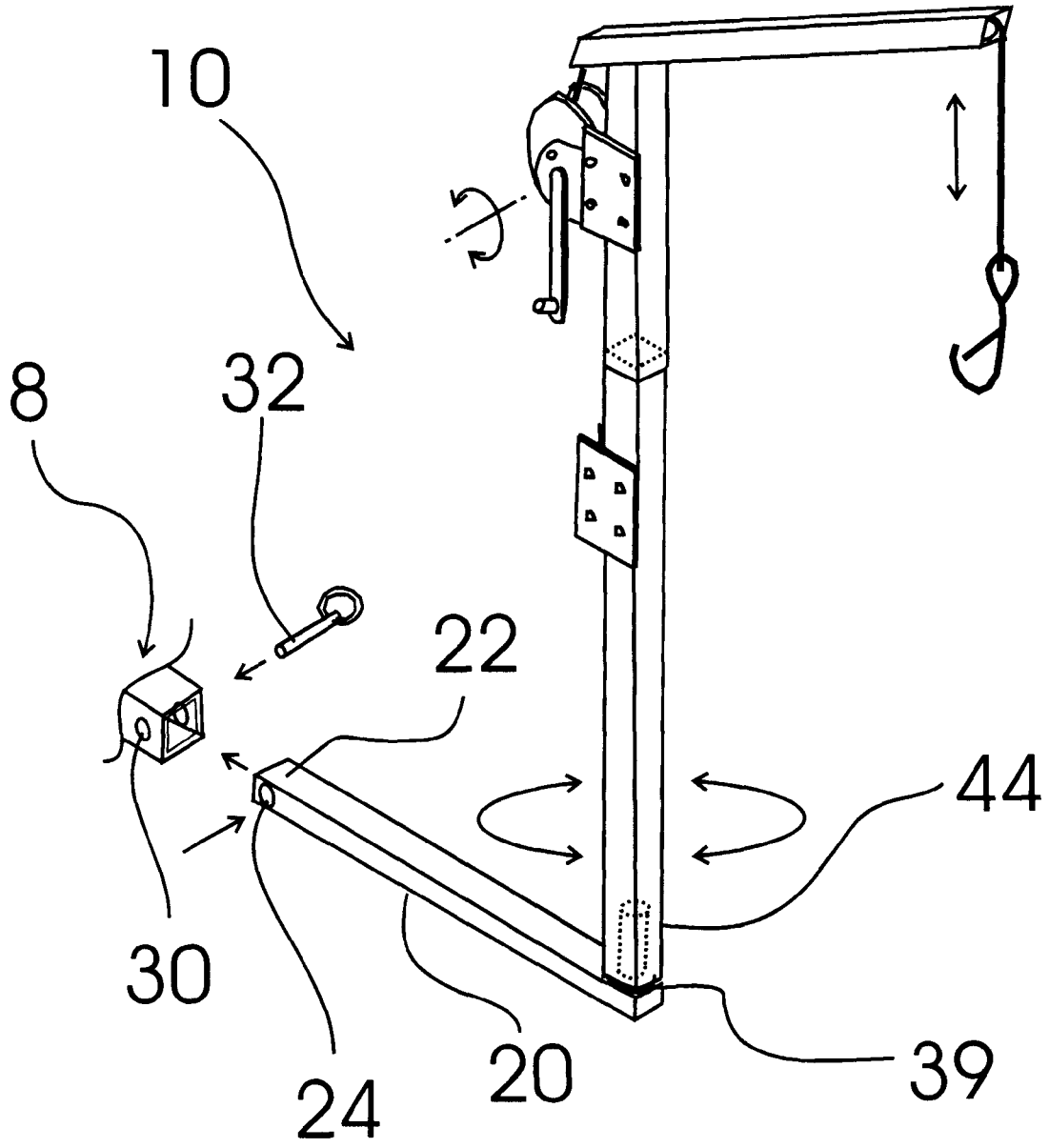
FIG. 1 is a perspective view of an exemplary embodiment of the load handling assembly of the present invention positioned adjacent to the receiver of a vehicle hitch assembly.
Figure 2:
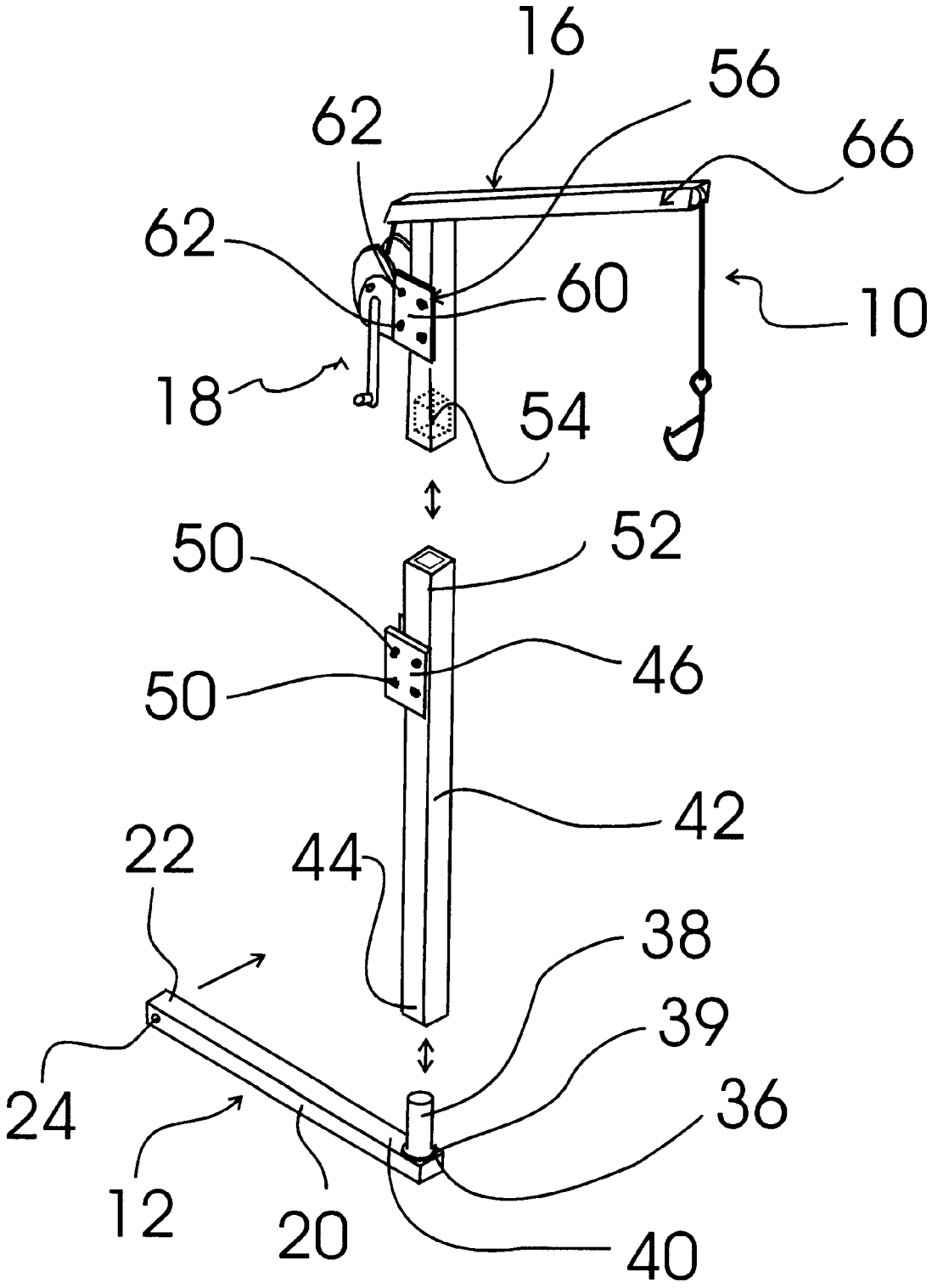
FIG. 2 is an exploded perspective view of the exemplary load handling assembly of FIG. 1; the load handling assembly including a receiver hitch insertable foot assembly, an upright leg assembly, a head assembly, and a winch assembly; the foot assembly including an elongated foot member having a first foot end sized and shaped to fit into the receiver of a receiver hitch assembly and that is provided with a pair of coaxially aligned securing pin apertures that are positioned on the first foot end such that they are alignable with receiver pin apertures formed through the receiver of the receiver hitch when the first end is inserted into the receiver, and a second foot end having a cylinder shaped, upright-connecting axle extending perpendicularly from a sidewall thereof; the upright leg assembly having a leg member including a tubular shaped first leg end having an axle receiving cavity provided therein sized and shaped to receive therein the cylinder shaped, upright-connecting axle such that the upright leg assembly is held in a perpendicular relationship to the foot member and constrained to rotate about cylinder shaped, upright-connecting axle, a leg assembly winch connecting bracket adapted for connection with the winch assembly and a second leg end adapted for connection with the head assembly; the head assembly including a head assembly leg connection structure adapted for connection with the second end of the leg member, a head assembly winch connecting bracket in connection with the head assembly leg connecting structure and adapted for connection with the winch assembly, a tubular, cable guide arm in rigid connection with the head assembly leg connection structure having cable guide passageway provided therethrough between a winch side end of the guide arm and an attachment hook side end of the guide arm, a winch side pulley rotatably installed partially within the cable guide passageway and extending partially past the winch side end of the guide arm, and an attachment hook side pulley rotatably installed partially within the cable guide passageway and extending partially past the attachment hook side end of the guide arm; the winch assembly including a winch mounting structure that is securable to the leg assembly winch connecting bracket and the head assembly winch connecting bracket and a winch in connection with the winch mounting structure having a winch reel having a first cable end of a length of cable wound thereon; the length of cable having a second cable end that is threaded over the winch side pulley, through the cable guide passageway over the attachment hook side pulley and in connection with an attachment hook.
Figure 3:
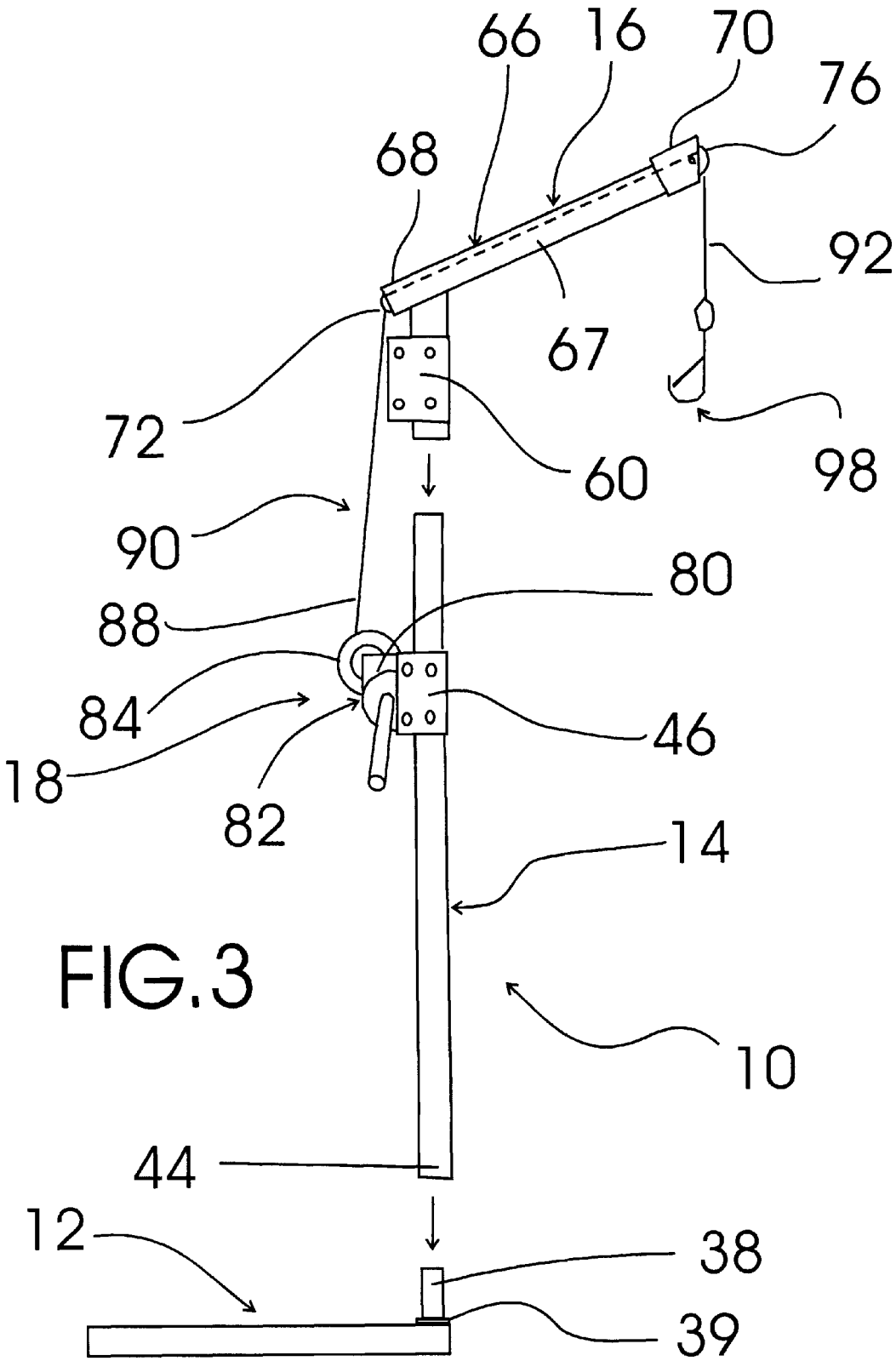
FIG. 3 is an exploded side plan view of the exemplary load handling assembly of FIG. 1 with the winch assembly attached to the leg assembly winch connecting bracket.
Figure 4:
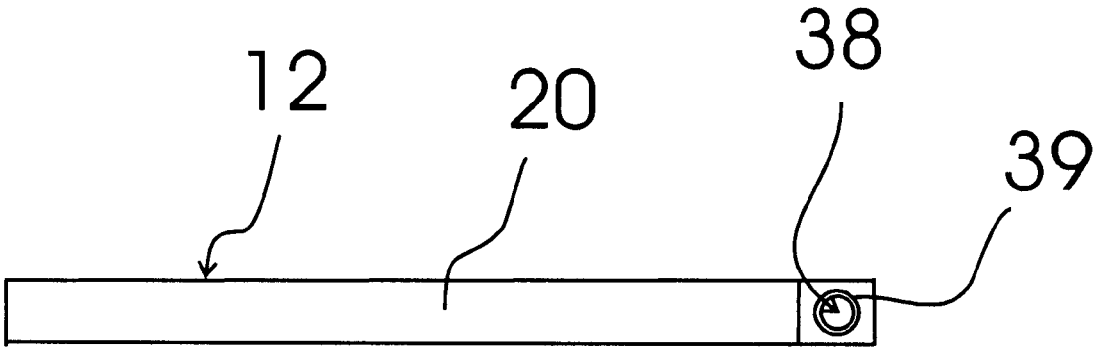
FIG. 4 is a plan view of the axle receiving cavity of the first leg end.
Figure 5:
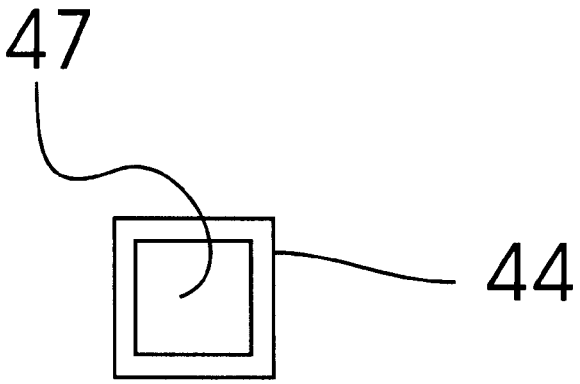
FIG. 5 is a top plan view of the foot assembly in isolation.

FIGS. 1–5 show various aspects of an exemplary embodiment of the load handling assembly of the present invention, generally designated 10. As discussed herein before, load handling assembly 10 is adapted for connection with the receiver, generally designated 8, of a receiver hitch assembly attached to a truck or similar vehicle.

Load handling assembly 10 includes a receiver hitch insertable foot assembly, generally designated 12; an upright leg assembly, generally designated 14; a head assembly, generally designated 16; and a winch assembly, generally designated 18. Foot assembly 12 is constructed of steel and includes a square crossectional, elongated foot member 20 having a first foot end 22 sized and shaped to fit into the receiver 8 of a receiver hitch assembly. First foot end 22 is provided with a pair of coaxially aligned securing pin apertures 24 that are positioned on first foot end 22 such that they are alignable with receiver pin apertures 30 formed through receiver 8 and used to secure foot assembly 20 to the receiver hitch with a securing pin 32. A second foot end 36 of foot member 20 has a cylinder shaped, upright-connecting axle 38 extending perpendicularly from a sidewall 40 thereof. A thrust bearing assembly 39 is provided around axle 38.

Upright leg assembly 14 is constructed from steel and has a leg member 42 including a tubular shaped first leg end 44 having an axle receiving cavity 47 provided therein that is sized and shaped to receive therein cylinder shaped, upright-connecting axle 38. When cylinder shaped, upright-connecting axle 38 is rotatably fit within axle receiving cavity 46, upright leg assembly 14 is held in a perpendicular relationship to foot member 20 and constrained to rotate about cylinder shaped, upright-connecting axle 38 supported on thrust bearing 39. A steel plate, leg assembly winch connecting bracket 46 is secured to leg member 42 and is provided with two securing apertures 50 for connection with winch assembly 18. Leg member 42 has a second leg end 52 that is shaped and sized to seat within a cavity 54 provided within head assembly 16. In use, winch assembly 18 is secured to leg assembly winch connecting bracket 46 when the operating is standing on the ground.

Head assembly 16 is of steel construction and includes a head assembly leg connection structure, generally designated 56, within which cavity 54 is formed. A head assembly winch connecting bracket, generally designated 60, is secured to head assembly leg connecting structure 56. Head assembly winch connecting bracket 60 has two securing apertures 62 that are used to secure winch assembly 18 to head assembly winch connecting bracket 60. In use, winch assembly 18 is connected to head assembly winch connecting bracket 60 when the user is standing on the bed of the truck.

Head assembly 16 also includes a tubular, steel, cable guide arm, generally designated 66 that is welded into rigid connection with head assembly leg connection structure 56 and that has a cable guide passageway 67 provided therethrough between a winch side end 68 of the guide arm and an attachment hook side end 70 of guide arm 66. A winch side pulley 72 rotatably installed partially within cable guide passageway 67 and extends partially past winch side end 68 of guide arm 66. An attachment hook side pulley 76 is rotatably installed partially within cable guide passageway 67 and extends out partially past attachment hook side end 70 of guide arm 66.

Winch assembly 18 is a conventional hand operated winch, model KX1052 hand winch manufactured by Fulton Work Winch, Mosinee, Wis., that includes a winch mounting structure 80 that is securable to either leg assembly winch connecting bracket 46 or head assembly winch connecting bracket 60. Winch assembly 18 includes a winch, generally designated 82 in connection with winch mounting structure 80 that has a winch reel 84 having a first cable end 88 of a length of cable 90 wound thereon. Length of cable 90 has a second cable end 92 that is threaded over winch side pulley 72, through cable guide passageway 67, over attachment hook side pulley 76 and in connection with an attachment hook, generally designated 98.

It can be seen from the preceding description that a load handling assembly has been provided.

It is noted that the embodiment of the load handling assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A load handling assembly is attachable to a receiver of a receiver hitch assembly of a vehicle; said load handling assembly comprising:

a receiver hitch insertable foot assembly;

an upright leg assembly;

a head assembly; and a winch assembly;

said foot assembly including an elongated foot member having a first foot end sized and shaped to fit into the receiver of a receiver hitch assembly and that is provided with a pair of coaxially aligned securing pin apertures that are positioned on said first foot end such that they are alignable with said receiver pin apertures formed through the receiver of the receiver hitch when said first end is inserted into the receiver, and a second foot end having a cylinder shaped, upright-connecting axle extending perpendicularly from a sidewall thereof;

said upright leg assembly having a leg member including a tubular shaped first leg end having an axle receiving cavity provided therein sized and shaped to receive therein said cylinder shaped, upright-connecting axle such that said upright leg assembly is held in a perpendicular relationship to said foot member and constrained to rotate about said cylinder shaped, upright-connecting axle, a leg assembly winch connecting bracket adapted for connection with said winch assembly and a second leg end adapted for connection with said head assembly;

said head assembly including a head assembly leg connection structure adapted for connection with said second end of said leg member, a head assembly winch connecting bracket in connection with said head assembly leg connecting structure and adapted for connection with said winch assembly, a tubular, cable guide arm in rigid connection with said head assembly leg connection structure having cable guide passageway provided therethrough between a winch side end of said guide arm and an attachment hook side end of said guide arm, a winch side pulley rotatably installed partially within said cable guide passageway and extending partially past said winch side end of said guide arm, and an attachment hook side pulley rotatably installed partially within said cable guide passageway and extending partially past said attachment hook side end of said guide arm;

said winch assembly including a winch mounting structure that is securable to said leg assembly winch connecting bracket and said head assembly winch connecting bracket and a winch in connection with said winch mounting structure having a winch reel having a first cable end of a length of cable wound thereon;

said length of cable having a second cable end that is threaded over said winch side pulley, through said cable guide passageway over said attachment hook side pulley and in connection with an attachment hook.

* * * * *